US011437180B2

(12) United States Patent
Li et al.

(10) Patent No.: US 11,437,180 B2
(45) Date of Patent: Sep. 6, 2022

(54) COIL ELECTRONIC COMPONENT

(71) Applicant: SAMSUNG ELECTRO-MECHANICS CO., LTD., Suwon-si (KR)

(72) Inventors: Yong Hui Li, Suwon-si (KR); Byung Soo Kang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 388 days.

(21) Appl. No.: 16/534,231

(22) Filed: Aug. 7, 2019

(65) Prior Publication Data

US 2020/0357565 A1 Nov. 12, 2020

(30) Foreign Application Priority Data

May 7, 2019 (KR) ..... 10-2019-0053091

(51) Int. Cl.
*H01F 27/28* (2006.01)
*H01F 17/00* (2006.01)
*H01F 27/29* (2006.01)

(52) U.S. Cl.
CPC ..... *H01F 27/2828* (2013.01); *H01F 17/0013* (2013.01); *H01F 27/2804* (2013.01); *H01F 27/29* (2013.01)

(58) Field of Classification Search
CPC ..... H01F 17/0013; H01F 2027/2809; H01F 17/0006; H01F 27/2804; H01F 5/003; H01F 27/29; H01F 27/292; H01F 27/2828

(Continued)

(56) References Cited

U.S. PATENT DOCUMENTS

2003/0030510 A1* 2/2003 Sasaki ..... H05K 3/3442 333/185
2015/0102891 A1* 4/2015 Yoon ..... H01F 27/2804 336/200

(Continued)

FOREIGN PATENT DOCUMENTS

JP 2018-174306 A 11/2018
JP 2018198269 A * 12/2018

(Continued)

OTHER PUBLICATIONS

Office Action issued in Korean Patent Application No. 10-2019-0053091 dated Apr. 24, 2020, with English translation.

*Primary Examiner* — Tszfung J Chan
(74) *Attorney, Agent, or Firm* — Morgan, Lewis & Bockius LLP

(57) ABSTRACT

A coil electronic component includes a body having a first surface and a second surface, opposing each other, and a third surface connecting the first surface and the second surface to each other, an insulating substrate disposed inside the body, a coil portion disposed on the insulating substrate, a first lead-out portion extending from one end portion of the coil portion and having a first spaced portion and a second spaced portion separate from each other by a first slit, whereby the first and second spaced portions are respectively exposed to the first surface and the third surface of the body, and a second lead-out portion extending from the other end portion of the coil portion and having a third spaced portion and a fourth spaced portion separate from each other by a second slit, whereby the third and fourth spaced portions are respectively exposed to the second surface and a third surface of the body.

10 Claims, 4 Drawing Sheets

(58) Field of Classification Search
USPC ..... 336/200, 232
See application file for complete search history.

(56) References Cited

U.S. PATENT DOCUMENTS

| | | | | |
|---|---|---|---|---|
| 2016/0343489 | A1* | 11/2016 | Horikawa | H01F 27/292 |
| 2017/0018360 | A1* | 1/2017 | Osada | H01G 4/248 |
| 2018/0286561 | A1 | 10/2018 | Shimoichi | |
| 2019/0096564 | A1 | 3/2019 | Park et al. | |

FOREIGN PATENT DOCUMENTS

| | | | | |
|---|---|---|---|---|
| KR | 10-2017-0003432 | A | | 1/2017 |
| KR | 10-2018-0012621 | A | | 2/2018 |
| KR | 20180012621 | A | * | 2/2018 |
| KR | 10-2019-0035435 | A | | 4/2019 |

* cited by examiner

COIL ELECTRONIC COMPONENT

CROSS-REFERENCE TO RELATED APPLICATION(S)

This application claims the benefit of priority to Korean Patent Application No. 10-2019-0053091 filed on May 7, 2019 in the Korean Intellectual Property Office, the disclosure of which is incorporated herein by reference in its entirety.

TECHNICAL FIELD

The present disclosure relates to a coil electronic component.

BACKGROUND

An inductor, a coil electronic component, is a representative passive element used in an electronic device, together with a resistor and a capacitor.

In a thin-film coil component, a coil is formed on an insulating substrate by a plating method to prepare a coil substrate, and a magnetic composite sheet, in which a magnetic powder particles and a resin are mixed, is laminated on the coil substrate. In the coil substrate, coils of individual components are arranged to be connected to each other in rows and columns. Then, the coil substrate is diced, and external electrodes are formed outside of a body having an individual size.

The coil substrate may have a structure in which lead-out portions of individual coils are connected to each other, and a dicing process is performed to cut lead-out portions of adjacent individual coils. During the dicing process, a metal, constituting a lead-out portion, may be pushed to a surface of the body by a pressure at the time of the dicing.

SUMMARY

An aspect of the present disclosure is to provide a coil electronic component which improves adhesion strength between a lead-out portion and a body and prevents a portion of a metal, constituting the lead-out portion, from being pushed to a surface of the body.

According to an aspect of the present disclosure, a coil electronic component includes a body having a first surface and a second surface, opposing each other, and a third surface connecting the first surface and the second surface to each other, an insulating substrate disposed inside the body, a coil portion disposed on the insulating substrate, a first lead-out portion extending from one end portion of the coil portion and having a first spaced portion and a second spaced portion separate from each other by a first slit, whereby the first and second spaced portions are respectively exposed to the first surface and the third surface of the body, and a second lead-out portion extending from the other end portion of the coil portion and having a third spaced portion and a fourth spaced portion separate from each other by a second slit, whereby the third and fourth spaced portions are respectively exposed to the second surface and a third surface of the body.

According to an aspect of the present disclosure, a coil electronic component includes a body having a first surface and a second surface, opposing each other, and a third surface connecting the first surface and the second surface to each other, and including a magnetic material; an insulating substrate disposed inside the body; a coil portion disposed on the insulating substrate; a first lead-out portion extending from one end portion of the coil portion and including a first extending portion and a second extending portion respectively exposed to the first surface and the third surface of the body; a second lead-out portion extending from the other end portion of the coil portion and including a third extending portion and a fourth extending portion respectively exposed to the second surface and the third surface of the body; a first groove portion disposed on an edge side between exposed surfaces of the first and second extending portions; and a second groove portion disposed on an edge side between exposed surfaces of the third and fourth extending portions.

to an aspect of the present disclosure, a coil electronic component includes a body having a first surface and a second surface, opposing each other, and a third surface connecting the first surface and the second surface to each other; an insulating substrate disposed inside the body; first and second coil portions respectively disposed on one surface and the other surface of the insulating substrate opposing each other, the first and second coil portions being disposed on opposing surfaces of the insulating substrate and being electrically connected to each other by a via electrode penetrating through the insulating substrate; a first lead-out portion extending from one end portion of the first coil portion and having a first spaced portion and a second spaced portion separate from each other by a first slit, whereby the first and second spaced portions are respectively exposed to the first surface and the third surface of the body; and a second lead-out portion extending from one end portion of the second coil portion and having a third spaced portion and a fourth spaced portion separate from each other by a second slit, whereby the third and fourth spaced portions are respectively exposed to the second surface and a third surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
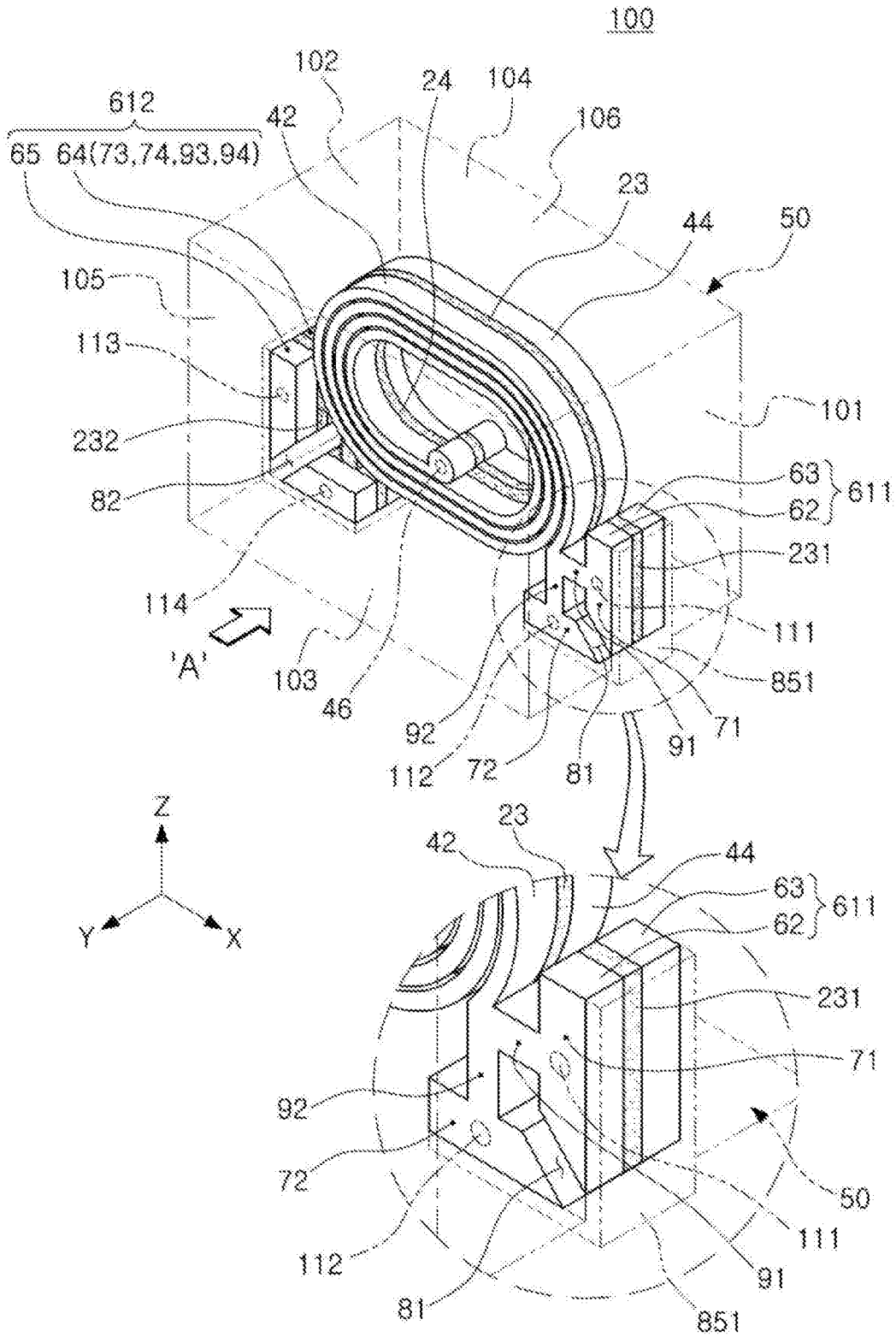
FIG. 1 is a schematic perspective view of a coil electronic component according to a first exemplary embodiment of the present disclosure.

The terminology used herein to describe exemplary embodiments of the present disclosure is not intended to limit the scope of the present disclosure. The articles "a," and "an" are singular in that they have a single referent, however the use of the singular form in the present document should not preclude the presence of more than one referent. In other words, elements of the present disclosure referred to in the singular may number one or more, unless the context clearly indicates otherwise. It will be further understood that the terms "comprise," "comprising," "include," and/or "including," when used herein, specify the presence of stated features, numbers, steps, operations, elements, and/or components but do not preclude the presence or addition of one or more other features, numbers, steps, operations, elements, components, and/or groups thereof.

In a description of the embodiment, in a case in which any one element is described as being formed on (or under) another element, such a description includes both a case in which the two elements are formed to be in direct contact with each other and a case in which the two elements are in indirect contact with each other such that one or more other elements are interposed between the two elements. In addition, when in a case in which one element is described as being formed on (or under) another element, such a description may include a case in which the one element is formed at an upper side or a lower side with respect to the another element.

Also, the sizes of components in the drawings may be exaggerated for convenience of description. In other words, since the sizes and thicknesses of components in the drawings are arbitrarily illustrated for convenience of description, the following embodiments are not limited thereto.

In the drawing, an X direction will be defined as a first direction or a length direction, a Y direction will be defined as a second direction or width direction, and a Z direction will be defined as a third direction or thickness direction.

Hereinafter, the exemplary embodiments of the present disclosure will be described in detail with reference to the accompanying drawings. The same or corresponding elements will be consistently denoted by the same respective reference numerals and described in detail no more than once regardless of drawing symbols.

Various types of electronic components are used in an electronic device. Various types of coil components may be appropriately used between such electronic components for the purpose of noise removal or the like.

In an electronic device, a coil component may be used as, for example, a power inductor, a high-frequency (HF) inductor, a general bead, a bead for high frequency (GHz Bead), a common mode filter, and the like.

Hereinafter, the present disclosure will be described under the assumption that a coil electronic component 10 according to exemplary embodiments is a thin-film inductor used in a power line of a power supply circuit. However, a coil electronic component according to exemplary embodiments may be appropriately applied to a chip bead, a chip filter, or the like in addition to the thin-film inductor.

Embodiment 1

Figure 2:
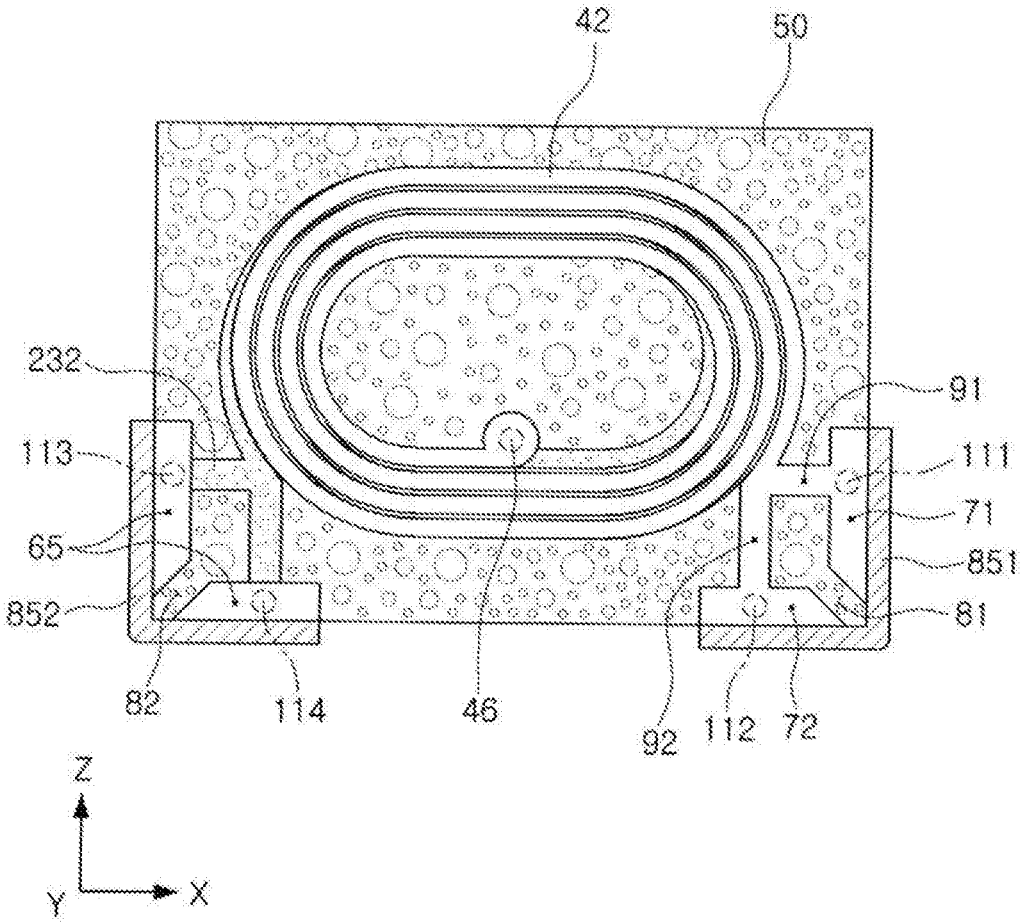
FIG. 2 is a diagram viewed in direction A of FIG. 1.

FIG. 1 is a schematic perspective view of a coil electronic component according to a first exemplary embodiment in the present disclosure, and FIG. 2 is a diagram viewed in direction A of FIG. 1.

Referring to FIGS. 1 and 2, a coil electronic component 100 according to the first exemplary embodiment may include a body 50, an insulating substrate 23, coil portions 42 and 44, and lead-out portions 611 and 612 and may further include external electrodes 851 and 852.

The body 50 may form an exterior of the electronic component 100, and the insulating substrate 23 is disposed inside the body 50.

The body 50 may be formed to have an approximately hexahedral shape.

The body 50 may have a first surface 101 and a second surface 102 opposing each other in a length direction X, a third surface 103 and a fourth surface 104 opposing each other in a width direction Y, and a fifth surface 105 and a sixth surface 106 opposing each other in a width direction Y, on the basis of FIG. 1. Each of the third and fourth surfaces 103 and 104, opposing each other, connects the first and second surfaces 101 and 102 opposing each other.

As an example, the body 50 may be formed such that the coil electronic component 100, on which external electrodes 851 and 852 to be described later are formed, has a length of 0.2±0.1 mm, a width of 0.25±0.1 mm, and a thickness of 0.4 mm, but the length, the width, and the thickness thereof are not limited thereto.

The body 50 may include a magnetic material and an insulating resin. Specifically, the body 50 may be formed by laminating an insulating resin and at least one magnetic sheet including a magnetic material dispersed in the insulating resin. However, the body 50 may have another structure, other than the structure in which the magnetic materials are disposed in the insulating resin. For example, the body 50 may include a magnetic material such as ferrite.

The magnetic material may be ferrite or metal magnetic powder particles.

The Ferrite powder particles may be at least one of, for example, spinel type ferrites such as ferrites that are Mg—Zn-based, Mn—Zn-based, Mn—Mg-based, Cu—Zn-based, Mg—Mn—Sr-based, Ni—Zn-based, hexagonal ferrites such as ferrites that are Ba—Zn-based, Ba—Mg-based, Ba—Ni-based, Ba—Co-based, Ba—Ni—Co-based, or the like, garnet ferrites such as Y-based ferrite, and Li-based ferrite.

The metal magnetic powder particles may include at least one selected from a group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particles may include at least one of pore ion power particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The metal magnetic powder particles may be amorphous or crystalline. For example, the metal magnetic powder particles may Fe—Si—B—Cr based amorphous alloy powder particles, but are not limited thereto.

Each of the ferrite and metal magnetic powder particles may have an average diameter of about 0.1 μm to about 30 μm, but the average diameter is not limited thereto.

The body 50 may include two or more types of magnetic materials dispersed in a resin. The expression "different types of magnetic materials" refers to the fact that magnetic materials, dispersed in a resin, are distinguished from each other by any one of average diameter, composition, crystallinity, and shape.

The insulating resin may include epoxy, polyimide, liquid crystal polymer, and the like, alone or in combination, but is not limited thereto.

The insulating substrate 23 may be disposed inside the body 50 and may have both surfaces on which coil portions 42 and 44 to be described later are disposed, respectively. The insulating substrate 23 may include a support portion 24, disposed inside the body 50, and tips 231 and 232 extending from the support portion 24 to be exposed to the external surfaces of the body 50. In the insulating substrate 23, the support portion 24 may be a region disposed between the coil portions 42 and 44 to support the coil portions 42 and 44. The tips 231 and 232 may be disposed between first and second lead-out portions 611 and 612 to support the lead-out portions 611 and 612, as will be described later. Specifically, a first tip 231 may extend from the support portion 24 and may be disposed between a first lead-out pattern 62 and a first dummy pattern 63 to support the first lead-out pattern 62 and the first dummy pattern 63. A second end portion 232 may extend from the support portion 24 and may be disposed between a second lead-out pattern 64 and a second dummy pattern 65 to support the second lead-out pattern 64 and the second dummy pattern 65.

The insulating substrate 23 may be formed of an insulating material including a thermosetting resin such as an epoxy resin, a thermoplastic resin such as a polyimide resin, or an insulating a photosensitive insulating resin, or an insulating material in which such an insulating resin is impregnated with a reinforcing material such as glass fiber and inorganic filler. For example, the insulating substrate 23 may be formed of an insulating material such as prepreg, Ajinomoto Build-up Film (ABF), FR-4, a Bismaleimide Triazine (BT) film, a photoimageable dielectric (PID) film, or the like, but an insulating material of the insulating substrate 23 is not limited thereto.

The inorganic filler may be at least one selected from the group consisting of silica ($SiO_2$), alumina ($Al_2O_3$), silicon carbide (SiC), barium sulfate ($BaSO_4$), talc, clay, mica powder particles, aluminum hydroxide ($AlOH_3$), magnesium hydroxide ($Mg(OH)_2$), a calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

The insulating substrate 23 may provide better rigidity when it is formed of an insulating material which includes a reinforcing material. The insulating substrate 23 may be advantageous in reducing an entire thickness of the coil portions 42 and 44 when it is formed of an insulating material which does not include a glass fiber.

The coil portions 42 and 44 may include first and second coil portions 42 and 44 disposed on one surface and the other surface of the insulating substrate 23 opposing each other, and may exhibit characteristics of a coil electronic component. For example, when the coil electronic component 100 is used as a power inductor, the first and second coil portions 42 and 44 may store an electric field as a magnetic field and maintain an output voltage to stabilize power of an electronic device. For brevity of description, one end portion and the other end portion of the first and second coil portions 42 and 44 may be referred to as one end portion of the first coil portion 42 and one end portion of the second coil portion 44, respectively.

The first and second coil portions 42 and 44 may be disposed on the support portion 24 of the insulating substrate 23. The first coil portion 42 and the second coil portion 44 may face each other and may be electrically connected to each other by a via electrode 46 penetrating through the support portion 24. The first coil portion 42 may be electrically connected to the first lead-out portion 62 and the second coil portion 44 may be electrically connected to the second lead-out portion 64, as will be described later.

Each of the first and second coil portions 42 and 44 may have a flat spiral shape forming at least one turn about a core portion. As an example, the first coil portion 42 may form at least one turn about the core portion on one surface of the insulating substrate 23.

According to the first exemplary embodiment, the first and second coil portions 42 and 44 may be formed to stand upright to the third surface 103 or the fourth surface 104 of the body 50.

As illustrated in FIG. 1, the expression "formed to stand upright to the third surface 103 or the fourth surface 104 of the body 50" refers to the fact that contact surfaces between the first and second coil portions 42 and 44 and the insulating substrate 23 are formed to be perpendicular or substantially perpendicular to the third surface 103 or the fourth surface 104 of the body 50. For example, the contact surface between the first and second coil portions 42 and 44 and the insulating substrate 23 may be formed to stand upright to the third surface 103 or the fourth surface 104 of the body 50 at an angle of 80 to 100 degrees.

The first and second coil portions 42 and 44 may be formed parallel to the fifth surface 105 and the sixth surface 106 of the body 50. For example, a contact surface between the first and second coil portions 42 and 44 and the insulating substrate 23 may be parallel to the fifth surface 105 and the sixth surface 106 of the body 50.

As the body 50 is miniaturized to have 1608 size or 1006 size or less, a body 50 having a thickness greater than a width is formed and a cross-sectional area of the body 50 in an XZ direction is larger than a cross-sectional area of the body 50 in an XY direction. Therefore, the first and second coil portions 42 and 44 may be formed to stand upright to the third surface 103 or the fourth surface 104 of the body 50 to increase an area in which the first and second coil portions 42 and 44 may be formed.

For example, when the body 50 has a length of 1.6±0.2 mm and a width is 0.8±0.05 mm, a thickness of the body 50 may satisfy a range of 1.0±0.05 mm (1608 size). When the body 50 has a length of 0.2±0.1 mm and a width of 0.25±0.1 mm, a thickness of the body 50 may satisfy a maximum range of 0.4 mm (1006 size). Since the thickness of the body 50 is greater than the width of the body 50, a larger area may be secured when the first and second coil portions 42 and 44 is vertical to the third surface 103 or the fourth surface 104 of the body 50 than when the first and second coil portions 42 and 44 is horizontal to the third surface 103 or the fourth surface 104 of the body 50. The larger the area in which the coil portions 42 and 44 are formed, the higher inductance L and quality factor Q.

The first and second coil portions 42 and 44 may include at least one conductor layer.

The first and second coil portions 42 and 44 may be formed of copper (Cu), aluminum (Al), silver (Ag), tin (Sn), gold (Au), nickel (Ni), lead (Pb), or alloys thereof, but a material of the first and second coil portions 42 and 44 is not limited thereto.

The lead-out portions 611 and 612 may extend, respectively, from both end portions of the first and second coil portions 42 and 44 and may be disposed on the tips 231 and 232 of the insulating substrate 23 to be exposed to external surfaces of the body 50. Referring to FIGS. 1 and 2, the first lead-out portion 611 may extend from one end of the first coil portion 42 to be exposed to the first surface 101 and the third surface 103 of the body 50, and the second lead-out portion 612 may extend from one end of the second coil portion 44 to be exposed to the second surface 102 and the third surface 103 of the body 50.

Referring to FIGS. 1 and 2, the lead-out portions 611 and 612 may have spaced portions 71, 72, 73, and 74 extending from one end portion and the other end portion of the first and second coil portions 42 and 44 to be separate from each other by slits 81 and 82. First and second spaced portions 71 and 72 extend from one end of the first coil portion 42 and are separate from each other by the first slit 81. A first slit 81 is formed in an edge region, connecting the first face 101 and the third face 103 of the body 50, to penetrate through and separate the first lead-out portion 611 in the width direction Y. The first slit 81 may penetrate not only the first lead-out portion 611 but also the first tip 231. The first lead-out portion 611 may be separated by the first slit 81, such that the first spaced portion 71 may be exposed to the first surface 101 of the body 50 and the second spaced portion 72 may be exposed to the third surface 103 of the body 50. Third and fourth spaced portions 73 and 74 may extend from one end portion of the second coil portion 44 to be separate from each other by a second slit 82. The second slit 82 may be formed in an edge region, connecting the second surface 102 and the third surface 103 of the body 50, to penetrate through and separate the second lead-out portion 612 in the width direction Y. The second slit 82 may penetrate through not only the second lead-out portion 612 but also the second tip 232. The second lead-out portion 612 may be separated by the second slit 82, such that the third spaced portion 73 may be exposed to the second surface 102 of the body 50 and the fourth spaced portion 74 may be exposed to the third surface 103 of the body 50.

As described above, since the slits 81 and 82 penetrate through the lead-out portions 611 and 612, one regions of the lead-out portions 611 and 612, formed in an edge region connecting the first and third surfaces 101 and 103 of the body 50 and in an edge region connecting the second and third surfaces 102 and 103, may be in the form of a void. In a dicing process after formation of the lead-out portions 611 and 612, a portion of a metal, disposed in the edge regions of the lead-out portions 611 and 612, may be pushed to a surface of the body 50 due to ductility of a metal, constituting the lead-out portions 611 and 612, and external force generated by a dicing blade. In this exemplary embodiment, a volume of the metal, disposed in the edge regions of the lead-out portions 611 and 612, may be reduced, and thus, an actual volume, occupied by the metal of the lead-out portions 611 and 612, may be reduced as compared to a volume occupied by the same lead-out portions 611 and 612. As a result, a metal component, constituting the lead-out portions 611 and 612, may be prevented from being pushed by the dicing blade during the dicing process.

In addition, adhesion strength between the body 50 and the lead-out portions 611 and 612 may be reduced by the external force generated by the dicing blade or the like. As an example, adhesion strength of a lead-out region, disposed on a bottom surface 103 of the body 50, may be reduced by external force applied to the side surfaces 101 and 102 of the body 50. In this exemplary embodiment, since the first lead-out portion 611 is separated into a first spaced portion 71, disposed on the side surface 101 of the body 50, and a second spaced portion 72 disposed on a bottom surface 103 of the body 50, an influence of the external force, applied to the side surface 101, on the bottom surface 103 may be significantly reduced. Similarly, an influence of the external force, applied to the bottom surface of the body 50, on the side surface 101 of the body 50 may be significantly reduced to improve adhesion strength of the lead-out region. In this exemplary embodiment, the second lead-out portion 612 is separated into a third spaced portion 73, disposed on a side surface 102 of the body 50, and a fourth spaced portion 74 disposed on the bottom surface 103 of the body 50, an influence of the external force, applied to the side surface 102 of the body 50, on the bottom surface 103 of the body 50 may be significantly reduced. Similarly, an influence of the external force, applied to the bottom surface 103 of the body 50, on the side surface 102 of the body 50 may be significantly reduced to improve the adhesion strength of the lead-out portion region.

Referring to FIGS. 1 and 2, the one end portion and the other end portion and the spaced portions 71, 72, 73, and 74 of the coil portions 42 and 44 may be connected by connection conductor portions 91, 92, 93, and 94. First and second connection conductor portions 91 and 92 may connect one end portion of the first coil portion 42 and the first and second spaced portions 71 and 72, respectively. Since the first connection conductor portion 91 is disposed between one end portion of the first coil portion 42 and the first spaced portion 71 and the second connection conductor portion 92 is disposed between one end of the first coil portion 42 and the second spaced portion 72, the first connection conductor portion 91 and the second connection conductor portion 92 are also spaced apart from each other. The third and fourth connection conductor portions 93 and 94 may connect one end portion of the second coil section 44 and the third and fourth spaced portions 73 and 74, respectively. Since the third connection conductor portion 93 is disposed between one end portion of the second coil portion 44 and the third spaced part 73 and the fourth connection conductor portion 94 is disposed between one end portion of the second coil portion 44, the third connection conductor portion 93 and the fourth connection conductor portion 94 are also spaced apart from each other.

According to the first exemplary embodiment, the lead-out portions 611 and 612 include lead-out patterns 62 and 64 and dummy patterns 63 and 65, as will be described later. Specifically, the first lead-out portion 611 includes a first lead-out pattern 62, disposed on one surface of the first tip 231 to be connected to one end portion of the first coil portion 42, and a first dummy pattern 63 disposed on the other surface of the first tip 231 to correspond to the first lead-out pattern 62. The second lead-out portion 612 includes a second lead-out pattern 64, disposed on the other surface of the second tip 232 to be connected to the other end portion of the second coil portion 44 and spaced apart from the first lead-out pattern 63, and a second dummy pattern disposed on one surface of the second tip 232 to correspond to the second lead-out pattern 64.

Referring to 1 and 2, one end of a first coil portion 42, disposed on one surface of an insulating substrate 23, may be extended to form the first lead-out pattern 62, and the first lead-out pattern 62 may be exposed to the first surface 101 and the third surface 103 of the body 50. One end portion of the second coil portion 44 may extend to the other surface of the insulating substrate 23, facing one surface of the insulating substrate 23, to form the second lead-out pattern 64. The second lead-out pattern 64 may be exposed to the second surface 102 and the third surface 103 of the body 50.

Referring to FIGS. 1 and 2, external electrodes 851 and 852 to be described later and the first and second coil portions 42 and 44 are connected to each other by the lead-out portions 611 and 612 disposed inside the body 50.

The lead-out portions 611 and 612 are disposed inside the body 50 to have an L shape. The lead-out portions 611 and 612 may be arranged to have a width narrower than a width of the body 50. The first and second lead-out portions 611 and 612 extend from the first surface 101 and the second surface 102 to be led out to the third surface 103, and may not be disposed on the fourth surface 104, the fifth surface 105, and the sixth surface 106 of the body 50.

The lead-out portions 611 and 612 may include a conductive metal such as copper (Cu) and are integrally formed when the first and second coil portions 42 and 44 are plated. The lead-out portions 611 and 612 are embedded inside the body 50 and are exposed to the first to third surfaces 101, 102, and 103 of the body 50. Accordingly, a contact area between a lead-out portion and an external electrode may be increased as compared with a bottom electrode structure according to a related art, and reliability of connection between the lead-out portion and the external electrode may be improved.

The connection conductor portions 91, 92, 93, and 94 may be disposed on the tips 231 and 232 to connect the lead-out patterns 62 and 64 and the first and second coil portions 42 and 44. Specifically, the first connection conductor portion 91 is disposed on one surface of the first tip 231 to connect the first lead-out pattern 62 and the first coil portion 42, and the second connection conductor portion 92 is disposed on one surface of the first tip 231 to connect the first lead-out pattern 62 and the first coil portion 42. Although not illustrated in detail, the third connection conductor portion 93 is disposed on the other surface of the second tip 232 to connect the second lead-out pattern 64 and the second coil portion 44, and the fourth lead-out portion 94 is disposed on the other surface of the tip 232 to connect the second lead-out pattern 64 and the second coil portion 44.

Referring to FIGS. 1 and 2, the connection conductor portions 91, 92, 93, and 94 may be formed as a plurality of conduction conductor portions spaced apart from each other, respectively. Since the connection conductor portions 91, 92, 93 and 94 are disposed as a plurality of connection conductor portions spaced apart from each other, the coil conductor portions 91, 92, 93, and 94 may reliability of connection between the first and second coil portions 42 and 44 and the lead-out patterns 62 and 64 as compared to a single shape. As an example, the first coil portion 42 and the first lead-out pattern 62 are connected by a plurality of the first and second connection conductor portions 91 and 92 spaced apart from each other. Therefore, even when any one of the first and second connection conductor portions 91 and 92 is damaged, electrical and physical connection between the first coil portion 42 and the first lead-out pattern 62 may be maintained through the other one of the first and second connection conductor portions 91 and 92. Similarly, the second coil portion 44 and the second lead-out pattern 64 are connected by a plurality of third and fourth connection conductor portions 93 and 94 spaced apart from each other. Therefore, even when any one of the third and fourth connecting conductor portions 93 and 94 is damaged, electrical and physical connection between the second coil portion 44 and the second lead-out pattern 64 may be maintained through the other one of the third and fourth connection conductor portions 93 and 94.

Since the connection conductor portions 91, 92, 93, and 94 are disposed as a plurality of connection conductor portions spaced apart from each other, the magnetic material of the body 50 may fill gaps between the respective connection conductor portions 91, 92, 93, and 94. For example, since the first and second connection conductor portions 91 and 92 are formed as a plurality of connection conductor portions spaced apart from each other, the magnetic material of the body 50 fills a gap between the first and second connection conductor portions 91 and 92. Bonding force between the first and second connection conductor portions 91 and 92 and the body 50 may be improved by such a filling portion. Similarly, since the third and fourth connection conductor portions 93 and 94 are formed as a plurality of connection conductor portions spaced apart from each other, the magnetic material of the body 50 fills a gap between the third and fourth connection conductor portions 93 and 94. Bonding force between the third and fourth connection conductor portions 93 and 94 and the body 50 may be improved by such a filling portion.

According to an example, the first and second coil portions 42 and 44, the lead-out portion 611 and 612, and the connection conductor portions 91, 92, 93, and 94 may be formed integrally with each other. Specifically, the first coil portion 42, the first lead-out pattern 62, and a first connection conductor 31 are formed integrally with each other, and the second coil portion 44, the second lead-out pattern 64, a second connection conductors 32 may be formed integrally with each other. A plating resist for formation of the first and second coil portions 42 and 44, the lead-out patterns 62 and 64, and the connection conductor portions 91, 92, 93, and 94 may be formed integrally with each other. Thus, the lead-out patterns 62 and 64 and the connection conductor portions 91, 92, 93, and 94 may also be plated when the first and second coil portions 42 and 44 are plated.

The lead-out patterns 62 and 64 and the dummy patterns 63 and 65 are disposed to correspond to the other surface and one surface of the insulating substrate 23, opposing each other, respectively. Since the coil electronic component 100 according to this exemplary embodiment further includes the dummy patterns 63 and 65 having a shape symmetrical to the lead-out patterns 62 and 64, the external electrodes 851 and 852 may be formed more symmetrically by plating. As a result, the coil electronic component 100 according to this exemplary embodiment may be more stably connected to a mounting substrate.

Referring to FIGS. 1 and 2, the external electrodes 851 and 852 and the first and second coil portions 42 and 44 are connected through the lead-out patterns 62 and 64 and the dummy patterns 63 and 65 disposed inside the body 50. The dummy patterns 63 and 65 may be connected to the lead-out patterns 62 and 64, respectively, by vias 111, 112, 113, and 114 and may be directly connected to the external electrodes 851 and 852. Referring to FIGS. 1 and 2, first and second vias 111 and 112 penetrate through the first tip 231 to electrically connect the first lead-out pattern 62 and the first dummy pattern 64. The first and second vias 111 and 112 electrically connect the first lead-out pattern 62 and the first dummy pattern 63 disposed symmetrically to the first tip 231 of the first and second spaced portions 71 and 72. Third and fourth vias 113 and 114 penetrate through the second tip 232 to electrically connect the second lead-out pattern 64 and the second dummy pattern 65. The third and fourth vias 113 and 114 electrically connect the second lead-out pattern 64 and the second dummy pattern 65 disposed symmetrically to the second tip 232 of the third and fourth spaced portions 71 and 72. The number of the vias 111, 112, 113 and 114 is not limited, and bonding between the lead-out patterns 62 and 64 and the dummy patterns 63 and 65 with the tips 231 and 232 interposed therebetween may be enhanced by the vias 111, 112, 113, and 114. Since the dummy patterns 63 and 65 are directly connected to the external electrodes 851 and 852, adhesion strength between the external electrodes 851 and 852 and the body 50 may be improved. The body 50 includes an insulating resin and metal magnetic powder particles, and the external electrodes 851 and 852 include a conductive metal. Since the body 50 and the external electrodes 851 and 852 include different materials, they strongly tend not to be mixed with each other. Accordingly, the dummy patterns 63 and 65 may be formed inside the body 50 and then exposed outwardly of the body 50 to achieve additional connection between the external electrodes 851 and 852 and the dummy patterns 63 and 65. Since the connection between the dummy patterns 63 and 65 and the external electrodes 851 and 852 is metal-to-metal bonding, boding force therebetween is greater than the bonding force between the body 50 and the external electrodes 851 and 852. Accordingly, adhesion force of the external electrodes 851 and 852 to the body 50 may be improved.

At least one of the first and second coil portions 42 and 44, the via electrode 46, the lead-out portions 611 and 612, and the connection conductor portions 91, 92, 93, and 94 includes at least one conductor layer. According to an example, each of the first and second coil portions 42 and 44, the via electrode 46, the lead-out portions 611 and 612, and the connection conductor portions 91, 92, 93, and 94 may include first conductor layers, disposed at the tips 231 and 232, and second conductor layers disposed at the first conductor layers. The second conductor layer may cover aside surface of the first conductor layer on the basis of the exposed surfaces of the first and second lead-out portions 611 and 612.

For example, when the first and second coil portions 42 and 44, the lead-out portions 611 and 612, the connection conductor portions 91, 92, 93, and 94, and the via electrode 46 are formed on both surfaces of the insulating substrate 23 by plating, each of the first and second coil portions 42 and 44, the lead-out portions 611 and 612, the connection conductor portions 91, 92, 93, and 94, and the via electrode 46 may include a first conductor layer, an electroless plating layer, and a second conductor layer, an electroplating layer. The electroplating layer may have a single-layer structure or a multilayer structure. An electroplating layer of a multilayer structure may be formed to have a conformal film structure in which one electroplating layer is covered with another electroplating layer, or may be formed to have a structure in which another electroplating layer is laminated on only one surface of one electroplating layer. A first conductor layer of the first and second coil portions 42 and 44, a first conductor layer of the lead-out patterns 62 and 64, the first conductor layer of the connection conductor portions 91, 92, 93 and 94, a first conductor layer of the dummy patterns 63 and 65, and a first conductor layer of the via electrode 46 may be formed integrally with each other, such that boundaries therebetween may not be formed, but is not limited thereto. An electroplating layer of the first and second coil portions 42 and 44, an electroplating layer of the lead-out patterns 62 and 64, an electroplating layer of the connection conductor portions 91, 92, 93, and 94, an electrolytic plating layer of the dummy patterns 63 and 65, and an electroplating layer of the electrode 46 may be formed integrally with each other, such that boundaries therebetween may not be formed, but is not limited thereto.

Each of the first and second coil portions 42 and 44, the lead-out portions 611 and 612, the connection conductor portions 91, 92, 93, and 94 and the via electrode 46 are formed of copper (Cu), aluminum (Al), silver (Ag), tin (Sn), gold (Au), nickel (Ni), lead (Pb), titanium (Ti), or alloys thereof, but a material thereof is not limited thereto.

In an example, a first conductor layer, a seed layer, is formed on one of one surface and the other surface of the insulating substrate 23, opposing each other, and a plating resist, having an opening for formation of a plating layer, is formed. The plating resist may be a typical photosensitive resist film, such as a dry film resist, but is not limited thereto. After the plating resist is applied, the opening for formation of a plating layer may be formed through exposure and development processes. The opening may be formed to correspond to each of the first and second coil portions 42 and 44, the lead-out portions 611 and 612, the connection conductor portions 91, 92, 93 and 94, and the via electrodes 46.

Alternatively, after a plating resist and a opening are formed on one surface of the insulating substrate 23, a plating resist and an opening may be formed on the other surface of the insulating substrate 23. Alternatively, a plating resist and an opening may be formed on one surface and the other surface together by the same process.

An opening for formation of a plating layer, disposed in one surface or the other surface of the insulating substrate 23 opposing each other, is filled with a conductive metal to form a second conductor layer. The opening for formation of a plating layer is filled with a conductive metal by electroplating to forma second conductor layer, and a via hole, not illustrated, is filled with a conductive metal by electroplating to form a via electrode 46. Thus, the first conductor layer may be disposed at the tips 231 and 232 of the insulating substrate 23, and a second conductor layer may be disposed at the first conductor layer.

By adjusting current density, concentration of a plating solution, a plating rate, and the like, during the electroplating, the second conductor layer may be formed as an isotropic growth plating layer in which a degree of growth in the width direction and a degree of growth in the thickness direction are similar to each other. As described above, by forming the second conductor layer as an isotropic growth plating layer, a difference in thickness between adjacent coils may be reduced to achieve a uniform thickness. Thus, a distribution of DC resistance Rdc may be reduced. In addition, by forming the second conductor layer as an isotropic growth plating layer, the first and second coil portions 42 and 44 and the lead-out portions 611 and 612 may be formed to be straight, without being bent, to prevent a short-circuit between adjacent coils and to prevent a defect in which an insulating layer, not illustrated, is not formed in portions of the first and second coil portions 42 and 44 and the lead-out portions 611 and 612.

The opening, formed on one surface of the insulating substrate 23, may be subjected to a plating process, and then the opening, formed on the other surface of the insulating substrate 23, may be filled with a conductive metal. However, the above order is not limited thereto, and the openings, formed on one surface and the other surface of the insulating substrate 23, opposing each other, may be simultaneously filled with a conductive metal by the same plating process.

Then, the plating resist is removed, and the first conductor layer is etched to form the first conductor layer only on a bottom surface of the second conductor layer.

A method of plating the first and second coil portions 42 and 44 is not limited to the above, and the first and second coil portions 42 and 44 may also be formed by a method of forming a plating resist on a side portion of the first conductor layer after forming the first conductor layer in the form of a coil pattern. A method of plating the lead-out portions 611 and 612 is not also limited to the above, and the lead-out portions 611 and 612 may be formed by forming a first conductor layer on a tip 231 such that spaced portions 71, 72, 73, and 74 are disposed and forming a plating resist on a side portion of the first conductor layer. Then, a conductive material fills an opening for formation of a second conductor layer, and then the plating resist is removed to form first and second coil portions 42 and 44 and lead-out portions 611 and 612. By such a method, the second conductor layer may be disposed to cover a side surface of the first conductor layer.

The first and second lead-out portions 611 and 612 are provided with first and second slits 81 and 82 on the basis of a surface exposed to an external surface of the body 50, respectively. In the first exemplary embodiment, the slits 81 and 82 may be formed to penetrate through the tips 231 and 232 and the lead-out portions 611 and 612, but the formation thereof is not limited thereto.

Specifically, the first slit 81 may be formed to penetrate through the first lead-out portion 611 and the first tip 231. After the above-mentioned plating resist is formed to correspond to first and second spaced portions 71 and 72, an opening of the plating resist is filled with a conductive material, such that first and second connection conductor portions 91 and 92 and first and the second spaced portions 71 and 72 are formed by plating. Similarly, the second slit 82 may be formed to penetrate through the second lead-out portion 612 and the second end portion 232. After the plating resist is formed to correspond to the third and fourth spaced portions 73 and 74, an opening portion of the plating resist is filled with a conductive material, such that third and fourth connection conductor portions 93 and 94 are formed by plating. As described above, the slits 81 and 82 are disposed to separate and penetrate through respective regions of the lead-out portions 611 and 612. Thus, a plating area itself, disposed in the lead-out portions 611 and 612, may be decreased to significantly reduce plating blurring in which a plating layer is pushed during a dicing process.

Although not illustrated, the coil electronic component 100 according to this exemplary embodiment may further include an insulating layer, not illustrated, disposed between each of the coil portions 42 and 42 and the lead-out portions 611 and 612, and the body 50. Since the first and second coil portions 42 and 44 and the lead-out portions 611 and 612 are integrally plated through the connection conductor portions 91, 92, 93, and 94, the insulating layer, not illustrated, may extend from the first and second coil portions 42 and 44 to the lead-out portions 611 and 612 along the connection conductor portions 91, 92, 93, and 94.

According to the first exemplary embodiment, the insulating layer, not illustrated, may cover the lead-out patterns 62 and 64, the dummy patterns 63 and 65, and the tips 231 and 232 to prevent a direct contact between a magnetic material, constituting the body 50, and plating layers of the first and second coil portions 42 and 44 and the lead-out portions 62 and 64.

The insulating layer, not illustrated, may be formed by coating an insulating material such as parylene through vapor deposition, but a formation method thereof is not limited thereto. For example, the insulating layer, not illustrated, may be formed by a known method such as a screen printing method, exposure of a photoresist (PR), a process through development, a spray coating process, or the like.

The external electrodes 851 and 852 are disposed on the first surface 101, the second surface 102, and the third surface 103 of the body 50.

Although not illustrated in detail, the first and second external electrodes 851 and 852 may be disposed on the first to third surfaces 101, 102, and 103 to be connected to the first to third lead-out portions 611 and 612 exposed to the first surface 101 and the third surface 103 of the body 50. Each of the external electrodes 851 and 852 may be disposed to have a width smaller than a width of the body 50. The first external electrode 851 may cover the first lead-out portion 611 and may extend from the first surface 101 of the body 50 to be disposed on the third surface 103. However, the first external electrode 851 is not disposed on the fourth surface 104, the fifth surface 105, and the sixth surface 106 of the body 50. The second external electrode 852 may cover the second lead-out portion 612 and may extend from the second surface 102 of the body 50 to be disposed on the third surface 103. However, the second external electrode 852 is not disposed on the fourth surface 104, the fifth surface 105, and the sixth surface 106 of the body 50.

Each of the external electrodes 851 and 852 may be formed to have a single-layer structure or a multilayer structure. The external electrode 851 may include a first layer, covering the lead-out portion 611, and a second layer covering the first layer. The external electrode 852 may include a first layer, covering the lead-out portion 612, and a second layer covering the first layer. Specifically, the first layer includes nickel (Ni) and the second layer includes tin (Sn).

Embodiment 2

Figure 3:
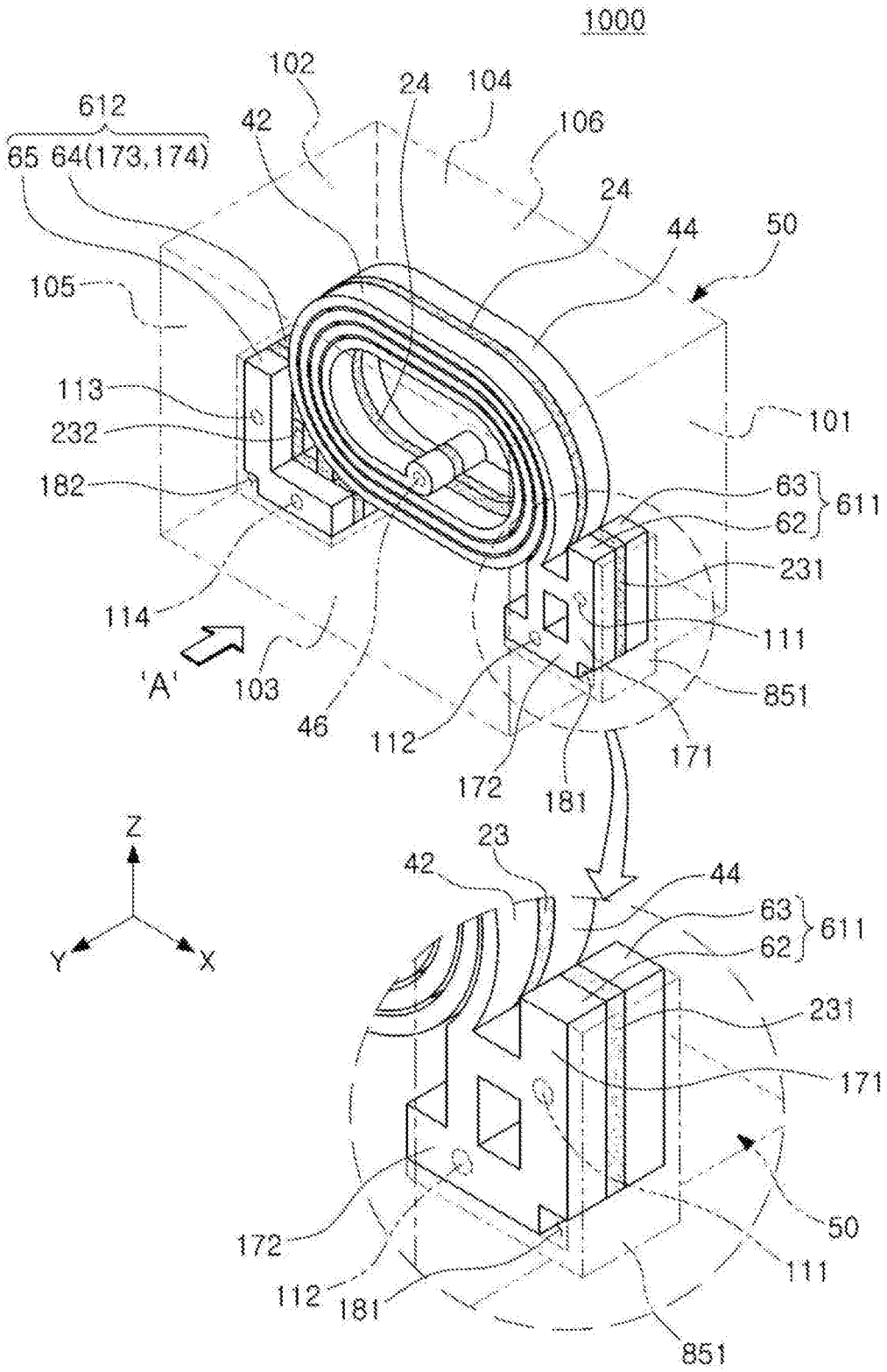
FIG. 3 is a schematic perspective view of a coil electronic component according to a second exemplary embodiment of the present disclosure.
Figure 4:
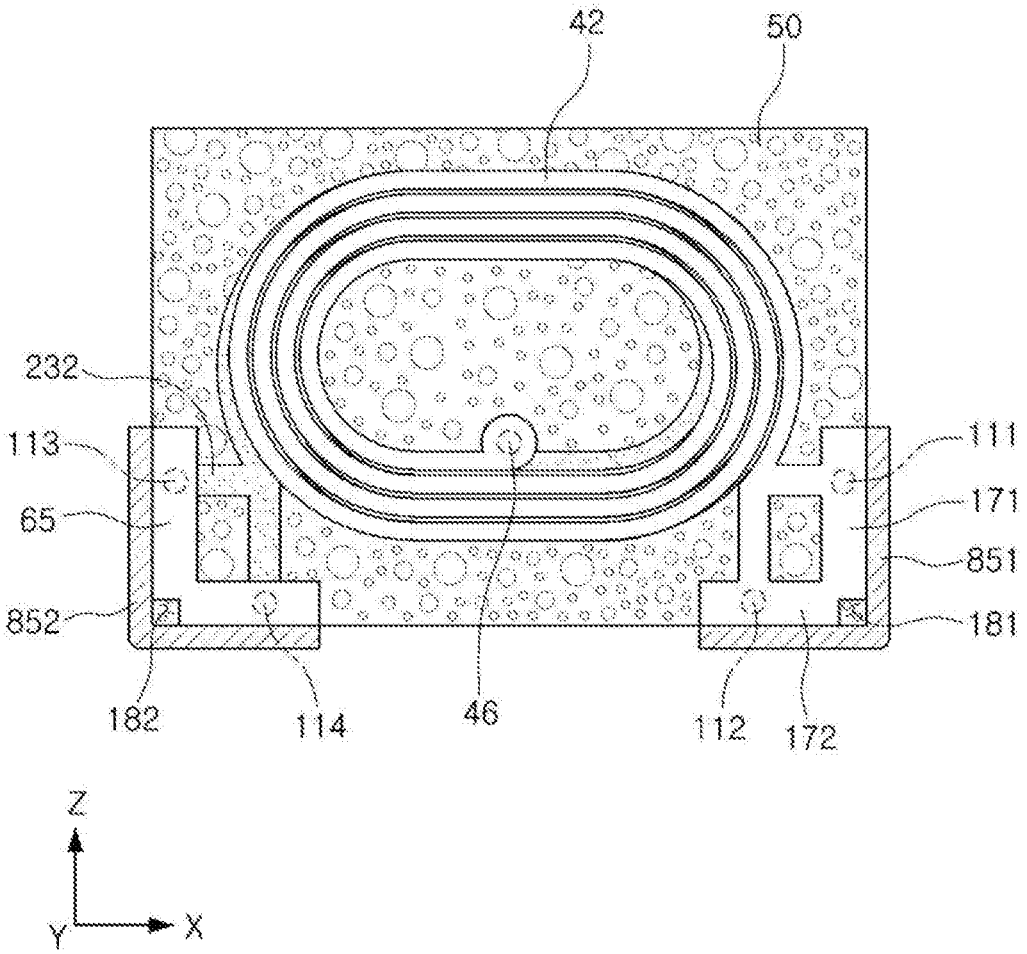
FIG. 4 is a diagram viewed in direction A of FIG. 3.

FIG. 3 is a schematic perspective view of a coil electronic component according to a second exemplary embodiment in the present disclosure, and FIG. 4 is a diagram viewed in direction A of FIG. 3.

Referring to FIGS. 3 and 4, a coil electronic component 1000 according to the second exemplary embodiment has groove portions 181 and 182, extending portions 171, 172, 173 and 174, and a filling portion, which are different from the configuration of the coil electronic component 100 according to the first exemplary embodiment. Therefore, the second exemplary embodiment will be described with focus on the groove portions 181 and 182, the extension portions 171, 172, 173, and 174, and the filling portion that are different from the configuration of the first exemplary embodiment. Descriptions of the other components of the second exemplary embodiment are the same as the descriptions of those of the first exemplary embodiment.

Referring to FIGS. 3 and 4, lead-out portions 611 and 612 extend from one end portion and the other end portion of first and second coil portions 42 and 44 to have the extending portions 171, 172, 173, and 174 partially separated by the groove portions 181 and 182.

Specifically, the first and second extending portions 171 and 172 extend from one end portion of the first coil portion 42 to be partially separated by the first groove portion 181. The first groove portion 181 is disposed at an edge side, connecting a first surface 101 and a third surface 103 of a body 50, and integrally penetrates through a first lead-out portion 611 and/or a first tip 231 to forma groove. The first lead-out portion 611 is partially separated by the first groove portion 181, such that the first extending portion 171 is exposed to the first surface 101 of the body 50 and the second extending portion 172 is exposed to the third surface of the body 50.

Third and fourth extending portions 173 and 174 extend from one end of a second coil portion 44 to be partially separated by the second groove portion 182. The second groove portion 182 is disposed at an edge side, connecting a second surface 102 and a third surface 103 of the body 50, and integrally penetrates through a second lead-out portion and/or a second tip 232 to form a groove. The second lead-out portion 612 is partially separated by the second groove portion 182, such that the third extending portion 173 is exposed to the second surface 101 of the body 50 and the fourth extending portion 174 is exposed to the third surface of the body 50.

Referring to FIGS. 3 and 4, first and second vias 111 and 112 penetrate through the first tip 231 to be electrically connected to a first lead-out pattern 62 and a first dummy pattern 63. Specifically, the first and second vias 111 and 112 electrically connect the first lead-out pattern 62 and the first dummy pattern 63 symmetrically disposed at the first tip 231 of the first and second extending portions 171 and 172. Third and fourth vias 113 and 114 penetrate through a second tip 232 to electrically connect a second lead-out pattern 64 and a second dummy pattern 65. The third and fourth vias 113 and 114 electrically connect a second lead-out pattern 65 and a second dummy pattern 65 symmetrically disposed at the second tip 232 of the third and fourth extending portions 173 and 174. The number of the vias 111, 112, 113, and 114 is not limited, and bonding between the lead-out patterns 62 and 64 and the dummy patterns 63 and 65 with the tips 231 and 231 interposed therebetween may be enhanced by the vias 111, 112, 113, and 113.

The first and second extending portions 171 and 172 are formed integrally with each other, and the third and fourth extending portions 173 and 174 are formed integrally with each other. For example, since the first and second coil portions 42 and 44 and the lead-out portions 611 and 612 are integrally plated through the extending portions 171, 172, 173, and 174, the first and second extending portions 171 and 172 are formed integrally with each other when the first coil portion 42 and the first lead-out portion 611 are plated, and the third and fourth extending portions 173 and 174 are formed integrally with each other when the second coil portion 44 and the second lead-out portion 612 are plated.

As described above, since the groove portions 181 and 182 penetrate through portions of the lead-out portions 611 and 612 to form grooves, one regions of the lead-out portions 611 and 612, disposed at an edge side connecting the first and third surfaces 101 and 103 of the body 50 and at an edge side connecting the second and third surfaces 102 and 103 of the body 50, may be in the form of a void. In a dicing process after formation of the lead-out portions 611 and 612, a portion of a metal, disposed in the edge regions of the lead-out portions 611 and 612, may be pushed to a surface of the body 50 due to ductility of a metal, constituting the lead-out portions 611 and 612, and external force generated by a dicing blade. In this exemplary embodiment, a volume of the metal, disposed in the edge regions of the lead-out portions 611 and 612, may be reduced, and thus, an actual volume of the metal of the lead-out portions 611 and 612 may be reduced as compared to a volume occupied by the same lead-out portions 611 and 612. As a result, a metal component, constituting the lead-out portions 611 and 612, may be prevented from being pushed by the dicing blade during the dicing process.

In addition, adhesion strength between the body 50 and the lead-out portions 611 and 612 may be reduced by the external force generated by the dicing blade or the like. As an example, adhesion strength of a lead-out region, disposed on a bottom surface 103 of the body 50, may be reduced by external force applied to the side surfaces 101 and 102 of the body 50. In this exemplary embodiment, since the first lead-out portion 611 is separated into a first spaced portion 71, disposed on the side surface 101 of the body 50, and a second spaced portion 72 disposed on a bottom surface 103 of the body 50, an influence of the external force, applied to the side surface 101, on the bottom surface 103 may be significantly reduced. Similarly, an influence of the external force, applied to the bottom surface of the body 50, on the side surface 101 of the body 50 may be significantly reduced to improve adhesion strength of the lead-out region. In this exemplary embodiment, the second lead-out portion 612 is separated into a third spaced portion 73, disposed on a side surface 102 of the body 50, and a fourth spaced portion 74 disposed on the bottom surface 103 of the body 50, an influence of the external force, applied to the side surface 102 of the body 50, on the bottom surface 103 of the body 50 may be significantly reduced. Similarly, an influence of the external force, applied to the bottom surface 103 of the body 50, on the side surface 102 of the body 50 may be significantly reduced to improve the adhesion strength of the lead-out portion region.

Referring to FIG. 4, the body 50 includes a filling portion, not illustrated, filling the groove portions 181 and 182. One side surface of the filling portion corresponding to the first surface 101 of the body 50 may be disposed on substantially the same plane as the exposed surface of the first extending portion 171. Another side surface of the filling portion corresponding to the second surface 102 of the body 50 may be disposed on substantially the same plane as the exposed surface of the third extending portion 173. Similarly, one surface of the filling portion corresponding to the third surface 103 of the body 50 may be disposed on substantially the same plane as the exposed surfaces of the second and fourth extending portions 172 and 174. Bonding force between the extending portions 171, 172, 173, and 174 and the body 50 may be improved by the filling portion.

In this exemplary embodiment, the groove portions 181 and 182 may extend to insides of the lead-out portions 611 and 612 to separate the extending portions 171, 172, 173 and 174 from each other. Although not illustrated in detail, the first groove portion 181 may extend inwardly of the first lead-out portion 611 to sectionalize the first and second extending portions 171 and 172 from each other, and the second groove portion 182 may extend inwardly of the second lead-out portion 612 to sectionalize the third and fourth extending portions 173 and 174 from each other. For example, the groove portions 181 and 182 may substantially penetrate through the extending portions 171, 172, 173 and 174 in a width direction Y.

Accordingly, a plating area itself, disposed in edge regions of the lead-out parts 611 and 612, may be decreased to reduce an actual volume, occupied by the metal of the lead-out portions 611 and 612, as compared to a volume occupied by the same lead-out portions 611 and 612. As a result, a metal component, constituting the lead-out portions 611 and 612, may be prevented from being pushed by the dicing blade during the dicing process. In addition, the first lead-out portion 611 is separated into a first extending portion 171, disposed on the side surface 101 of the body 50, and a second extending portion 172 disposed on a bottom surface 103 of the body 50, and the second extending portion 612 is separated into the third extending portion 173, disposed on a side surface 102 of the body 50, and a fourth extending portion 174 disposed on a bottom surface 103 of the body 50. Therefore, an influence of external force, applied to the side surfaces 101 and 102 of the body 50, on the bottom surface 103 of the body 50 may be reduced.

As described above, according to the present disclosure, adhesion strength between a lead-out portion and a body of a coil electronic component may be enhance, and a portion of a metal, constituting the lead-out portion, may be prevented from being pushed to a surface of the body.

While exemplary embodiments have been shown and described above, it will be apparent to those skilled in the art that modifications and variations could be made without departing from the scope of the present disclosure as defined by the appended claims.

What is claimed is:

1. A coil electronic component:

a body having a first surface and a second surface, opposing each other, and a third surface connecting the first surface and the second surface to each other;

an insulating substrate disposed inside the body;

a coil portion disposed on the insulating substrate;

a first lead-out portion extending from one end portion of the coil portion and having a first spaced portion and a second spaced portion separate from each other by a first slit, whereby the first and second spaced portions are respectively exposed to the first surface and the third surface of the body;

a second lead-out portion extending from another end portion of the coil portion and having a third spaced portion and a fourth spaced portion separate from each other by a second slit, whereby the third and fourth spaced portions are respectively exposed to the second surface and a third surface of the body;

first and second connection conductor portions branching from the one end portion of the coil portion and respectively connecting the first and second spaced portions to the one end portion of the coil portion; and third and fourth connection conductor portions branching from the another end portion of the coil portion and respectively connecting the third and fourth spaced portions to the another end portion of the coil portion.

2. The coil electronic component of claim 1, wherein the body includes a magnetic material, a portion of which is disposed in a gap between the first and second connection conductor portions and a gap between the third and fourth connection conductor portions.

3. The coil electronic component of claim 2, wherein the first and second connection conductor portions are respectively disposed between the one end portion of the coil portion and the first spaced portion and between the one end portion of the coil portion and the second spaced portion to be spaced apart from each other, and the third and fourth connection conductor portions are respectively disposed between the another end portion of the coil portion and the third spaced portion and between the another end portion of the coil portion and the fourth spaced portion to be spaced apart from each other.

4. The coil electronic component of claim 1, wherein the first slit is arranged in an edge connecting the first and third surfaces of the body to each other, and the second slit is arranged in an edge connecting the second and third surfaces of the body to each other.

5. The coil electronic component of claim 1, wherein the insulating substrate comprises:

a support portion disposed on the coil portion; and a first tip and a second tip respectively disposed on the first lead-out portion and the second lead-out portion, wherein the first slit penetrates through the first lead-out portion and the first tip, and the second slit penetrates through the second lead-out portion and the second tip.

6. The coil electronic component of claim 5, wherein the first lead-out portion comprises:

a first lead-out pattern disposed on one surface of the first tip to be connected to the one end portion of the coil portion; and a first dummy pattern disposed on another surface of the first tip to correspond to the first lead-out pattern, and the second lead-out portion comprises:

a second lead-out pattern disposed on one surface of the second tip to be connected to the another end portion of the coil portion, the second lead-out pattern being spaced apart from the first dummy pattern; and a second dummy pattern disposed on another surface of the second tip to correspond to the second lead-out pattern.

7. The coil electronic component of claim 6, wherein the first and second dummy patterns are respectively connected to the first and second lead-out patterns by vias.

8. The coil electronic component of claim 1, wherein each of the first and second lead-out portions has a width narrower than a width of the body.

9. The coil electronic component of claim 1, further comprising:

a first external electrode and a second external electrode respectively covering the first lead-out portion and the second lead-out portion.

10. A coil electronic component:

a body having a first surface and a second surface, opposing each other, and a third surface connecting the first surface and the second surface to each other;

an insulating substrate disposed inside the body;

first and second coil portions respectively disposed on one surface and another surface of the insulating substrate opposing each other, the first and second coil portions being disposed on opposing surfaces of the insulating substrate and being electrically connected to each other by a via electrode penetrating through the insulating substrate;

a first lead-out portion extending from one end portion of the first coil portion and having a first spaced portion and a second spaced portion separate from each other by a first slit, whereby the first and second spaced portions are respectively exposed to the first surface and the third surface of the body;

a second lead-out portion extending from one end portion of the second coil portion and having a third spaced portion and a fourth spaced portion separate from each other by a second slit, whereby the third and fourth spaced portions are respectively exposed to the second surface and a third surface of the body;

first and second connection conductor portions branching from the one end portion of the first coil portion and respectively connecting the first and second spaced portions to the one end portion of the first coil portion; and third and fourth connection conductor portions branching from the one end portion of the second coil portion and respectively connecting the third and fourth spaced portions to the one end portion of the second coil portion.

* * * * *